US009295864B2

(12) United States Patent
Ji et al.

(10) Patent No.: US 9,295,864 B2
(45) Date of Patent: Mar. 29, 2016

(54) FIRE EXTINGUISHING COMPOSITION OF COPPER SALTS

(75) Inventors: Tao Ji, Shaanxi (CN); Tao Wei, Shaanxi (CN)

(73) Assignee: XI'AN J&R FIRE FIGHTING EQUIPMENT CO., LTD., Shaanxi (CN)

( * ) Notice: Subject to any disclaimer, the term of this patent is extended or adjusted under 35 U.S.C. 154(b) by 4 days.

(21) Appl. No.: 14/239,118

(22) PCT Filed: Aug. 14, 2012

(86) PCT No.: PCT/CN2012/080097

§ 371 (c)(1),
(2), (4) Date: Feb. 14, 2014

(87) PCT Pub. No.: WO2013/023576

PCT Pub. Date: Feb. 21, 2013

(65) Prior Publication Data

US 2014/0183400 A1 Jul. 3, 2014

(30) Foreign Application Priority Data

Aug. 16, 2011 (CN) ..... 2011 1 0235064

(51) Int. Cl.
*A62D 1/06* (2006.01)
*A62D 1/00* (2006.01)

(52) U.S. Cl.
CPC ..... *A62D 1/0007* (2013.01); *A62D 1/06* (2013.01)

(58) Field of Classification Search
CPC ..... A62D 1/0007; A62D 1/06
See application file for complete search history.

(56) References Cited

FOREIGN PATENT DOCUMENTS

| | | | |
|---|---|---|---|
| GB | 385860 A | * | 1/1933 |
| JP | 63-268796 A | * | 11/1988 |
| JP | 2-56108 B2 | | 11/1990 |
| SU | 1085043 A1 | | 3/1992 |

OTHER PUBLICATIONS

English abstract of JP 63-268796 A (1988).*
International Search Report (Form PCT/ISA/210) for PCT/CN2012/080097, mailed Nov. 1, 2012.

* cited by examiner

*Primary Examiner* — Peter F Godenschwager
(74) *Attorney, Agent, or Firm* — Koppel, Patrick, Heybl & Philpott

(57) ABSTRACT

Disclosed is a fire extinguishing composition of copper salts, which comprises a compound of copper salts and a fire retardant component with the content of 30 wt %-95 wt % for the former and 5 wt %-70 wt % for the latter respectively. A pyrotechnic agent in the composition serves as heat source and power source, and through being ignited, the pyrotechnic agent is burnt to generate high temperature to enable the composition to perform decomposition reaction so that a large quantity of the resulting fire extinguishing substances can be spouted out with the pyrotechnic agent to achieve an object of fire extinguishing. The fire extinguishing composition of copper salts can decrease the quantity of heat released by combustion of the pyrotechnic agent rapidly and efficiently, thus greatly reducing the nozzle temperature of a fire extinguishing apparatus and a sprayed substance, avoiding use of a complicated cooling system of the fire extinguishing apparatus, and also eliminating the danger of a secondary fire. the fire extinguishing composition releases a great deal of an effective fire extinguishing substance at the moment of being heated, through the synergistic effect of various particles, the fire extinguishing time is greatly shortened.

11 Claims, No Drawings

FIRE EXTINGUISHING COMPOSITION OF COPPER SALTS

The application depends on and claims the priority of Chinese patent application 201110235064.6, filed on Aug. 16, 2011, the entire contents of which are incorporated herein by reference.

TECHNICAL FIELD OF THE APPLICATION

The present disclosure belongs to the field of fire control and extinguishment technology, and particularly relating to an aerosol fire-extinguishing composition.

BACKGROUND OF THE APPLICATION

The famous Vienna Convention and Montreal Convention on protection of the ozone layer and elimination of substances depleting the ozone layer were signed by major countries in the world between 1985 and 1987. Against this background, the Halon fire extinguisher which can damage the ozone layer has been forbidden in developed countries in Europe and America, and is also eliminated in other countries. In 1992, Country Programme to Phase Out Substances that Deplete the Ozone Layer was formulated in China. The fire control industry in China completed a task for eliminating Halon 1211 on Dec. 31, 2005. The production of Halon 1301 has been stopped since Jan. 1, 2006, and the application of Halon was completely stopped at the end of 2010. Therefore, it is one of the research hotspots in every country in recent years to seek for non-toxic harmless Halon extinguisher substitute products and technologies with high fire extinguishing efficiency and without damage to the atmospheric ozone layer. There are three major Halon substitute products which have been researched and produced widely: halogenated hydrocarbon fire-extinguishers, inert gas fire-extinguishers and aerosol fire-extinguishers. The aerosol fire-extinguishers are a kind of non-toxic harmless novel fire-extinguishers which is extremely high in fire extinguishing efficiency and low in price and equipment investment with a zero Ozone Depletion Potential (ODP) and no residues. Against the urgent background of the elimination of Halon, aerosol fire extinguishing technology, which is strongly supported by the government and meets market demands, has become one of the Halon substitute technologies which are very noticeable in the last decade.

An aerosol fire-extinguisher is composed of an oxidant, a reducing agent, a combustion speed controller and an adhesive, and mainly includes an S-type aerosol fire-extinguisher and a K-type aerosol fire-extinguisher, and main fire-extinguishing mechanisms are as follows: 1. heat absorption and temperature reduction; 2. chemical inhibition; 3. smothering; 4. isolation, mainly chemical inhibition. Although the aerosol fire-extinguisher is apparently advantageous in aspects of fire-extinguishing efficiency, storage conditions, engineering cost, maintenance and management, toxicity, secondary damage, environment protection and fire-extinguishing concentration etc., a redox reaction of the aerosol fire-extinguisher will release a great deal of gases and active particles while releasing a great deal of heat to bring disadvantages to the use of the aerosol fire-extinguisher. In order to effectively reduce apparatus and aerosol temperature and avoid a secondary fire, a cooling system needs to be added to a fire-extinguishing apparatus. Pure physical cooling may result in a complicated and heavy apparatus structure, complicated technological processes and high cost. In addition, the cooling system inactivates a great deal of active particles, thus greatly reducing the fire-extinguishing performance. In addition, affected by the cooling performance, the nozzle temperature of existing aerosol fire-extinguishing products is usually too high, which is easy to cause injuries to an operator.

SUMMARY OF THE APPLICATION

To solve the technical problems existing in aerosol fire-extinguisher in the prior art, the present disclosure provides a fire extinguishing composition which is high in fire extinguishing effect, safe and reliable, and more environment-friendly.

A technical solution applied by the present disclosure to solve the technical problems is as follows:

a fire extinguishing composition of copper salts is special in that: the fire extinguishing composition contains a compound of copper salts and a fire retardant component, respectively in the following mass ratios:

30% to 95% of the compound of copper salts

5% to 70% of the fire retardant component.

The fire extinguishing composition uses a pyrotechnic agent as a heat source and a power source, and through being ignited, the pyrotechnic agent is burnt to generate high temperature to enable the composition to perform decomposition reaction so that a large quantity of the resulting fire extinguishing substances can be spouted out with the pyrotechnic agent to achieve an object of fire extinguishing while reducing nozzle temperature through an endothermic reaction.

An additive with hydroxypropyl methylcellulose, an acetal adhesive, magnesium stearate or talcum powder or a combination thereof as a main component may be further added to the fire extinguishing composition of the present disclosure, and the mass ratio of the additive is more than 0, and less than or equal to 10%, preferably 1% to 5%.

The fire extinguishing composition of copper salts includes an organic copper compound or an inorganic copper compound or a combination thereof, with a preferred mass percent of 60% to 90%, preferably in the range of 80% to 90%, and the melting point of the organic copper compound or the inorganic copper compound or the combination thereof is above 100° C., and the decomposition temperature is above 200° C. and a decomposition product of the fire extinguishing composition is capable of extinguishing a fire. Such the fire extinguishing composition is heated to decompose to generate a great deal of a fire extinguishing substance which is spouted out with the pyrotechnic agent to achieve a fire extinguishing effect.

The organic copper compound may be copper acetate, copper oxalate, copper oleate, copper linoleate, copper stearate, copper citrate, copper tartrate, 2-hydroxybutanedioic copper, copper benzoate, or copper salicylate or a mixture thereof; the inorganic copper compound may be copper carbonate, copper sulfate, copper nitrate, copper chloride, copper hydroxide, copper sulfite, basic copper carbonate or copper thiosulfate or a mixture thereof.

In order to enhance the fire extinguishing effect, the fire extinguishing composition includes a fire retardant component. The decomposition temperature of the fire retardant component is above 100° C., and the fire retardant component can release, in a decomposition process, $CO_2$, $N_2$ and $H_2O$ having an fire retardant effect, and compounds of gaseous, liquid, solid particles including active compound particles etc. that can capture fire-extinguishing free radicals and the mass percent of the fire retardant component is 5% to 70%, preferably 5% to 40%, and a particularly preferred mass percent is 5% to 15%.

The fire retardant component may be selected from an inorganic flame retardant, a halogen-based flame retardant, a phosphorus-based flame retardant or a nitrogen-based flame retardant or a combination thereof.

The flame inhibition mechanism of the efficient fire extinguishing composition of the present disclosure is as follows: when in use, a pyrotechnic agent is adopted as as a heat source and a power source, by igniting the pyrotechnic agent, the fire extinguishing composition can be dehydrated and cooled at a high temperature, then further decompose and release a fire extinguishing substance under the effect of high temperature caused by burning the pyrotechnic agent. The fire extinguishing substance can react with one or more of O., OH., H. free radicals which are necessary for the chain combustion reaction via free radicals, so as to cut off the chain combustion reaction; and also can reduce the partial pressure of oxygen via physical effect to inhibit flames, or can simultaneously generate a physical and chemical inhibition effect to together realize fire extinguishment; meanwhile, it can generate synergistic interaction with the pyrotechnic agent to further improve the fire extinguishing effectiveness of the fire extinguisher, which greatly shortens the effective fire extinguishing time. Compared with traditional fire extinguishing compositions, the present disclosure can provide a more efficient and safer fire extinguishing composition.

A fire extinguishing composition of copper salts involved in the present disclosure has the following major advantages:

first, when heated at a high temperature, the fire extinguishing composition of copper salts of the present disclosure can absorb heat and decompose rapidly, and the heat absorption can effectively and rapidly reduce the heat released by burning the pyrotechnic agent, thus greatly reducing the nozzle temperature of a fire extinguishing apparatus and a sprayed substance, avoiding use of a complicated cooling system of the fire extinguishing apparatus, and also eliminating the danger of a secondary fire; in addition, the fire extinguishing composition releases a great deal of an effective fire extinguishing substance at the moment of being heated, and the effective fire extinguishing substance mainly includes liquid or solid particles; through the synergistic effect of various particles, the fire extinguishing time is greatly shortened;

secondly, an flame retardant may be further added to the fire extinguishing composition of the present disclosure; through the fire retardant effect of a decomposition product, the flame retardant can reduce the possibility of re-combustion of a fire source, and further improve the fire extinguishing effect of the fire extinguisher;

3. the fire extinguishing composition of copper salts of the present disclosure is easy to process and shape, and may be used separately or matched with a physical coolant;

4. the fire extinguishing composition of the present disclosure is easy to store for a long time with stable performance, no toxicity, and good environment friendliness.

DETAILED DESCRIPTION OF THE APPLICATION

A fire extinguishing composition of copper salts of the present disclosure will be further described in combination with experimental examples:

the fire extinguishing composition of copper salts of the present disclosure mainly includes a compound of copper salts and a fire retardant component, wherein the compound of copper salts mainly includes organic copper compound or an inorganic copper compound or a combination thereof having a preferred melting point of above 100° C., a decomposition temperature of above 200° C., and a decomposition product capable of extinguishing a fire; in use, it is prefer to control the mass percent of the fire extinguishing composition of copper salts within 30% to 95%, preferably 80% to 90%, and the fire retardant component mainly includes an inorganic flame retardant, a halogen-based flame retardant a phosphorus-based flame retardant or a nitrogen-based flame retardant or a combination thereof having a mass ratio of 5% to 70%, preferably 5% to 40%, and a particularly preferred mass ratio of 5% to 15%. The fire extinguishing composition uses a pyrotechnic agent as a heat source and a power source, and through being ignited, the pyrotechnic agent is burnt to generate high temperature to enable the composition to perform decomposition reaction so that a large quantity of the resulting fire extinguishing substances can be spouted out with the pyrotechnic agent to achieve an object of fire extinguishing. At the same time, the fire extinguishing composition can absorb a part of the heat through an endothermic reaction, thus effectively reducing nozzle temperature.

The organic copper compound may be selected from copper acetate, copper oxalate, copper oleate, copper linoleate, copper stearate, copper citrate, copper tartrate, 2-hydroxybutanedioic copper, copper benzoate, or copper salicylate or a mixture thereof; the inorganic copper compound may be copper carbonate, copper sulfate, copper nitrate, copper chloride, copper hydroxide, copper sulfite, basic copper carbonate or copper thiosulfate or a mixture thereof.

To enhance the performance of the fire extinguishing composition of copper salts, some additives e.g. hydroxypropyl methylcellulose, an acetal adhesive, magnesium stearate or talcum powder or a combination thereof, may be added to the fire extinguishing composition of the present disclosure. The mass percent of the additive is more than 0, and less than or equal to 10%, preferably 1% to 5%, which may be further adjusted appropriately according to use conditions. The additive further contains an adhesive. However, the adhesive and the content thereof belong to general knowledge of the art, and the content is generally controlled below 15%.

The decomposition temperature of the fire retardant component is preferably above 100° C. , and the fire retardant component releases compounds of gaseous, liquid or solid particles having a fire retardant effect during a decomposition process, generally referring to $CO_2$, $N_2$, $H_2O$ or other active compound particles that can capture fire extinguishing free radicals. The fire retardant component is selected from an inorganic flame retardant, a halogen-based flame retardant, a phosphorus-based flame retardant or a nitrogen-based flame retardant or a combination thereof having a mass ratio of 5% to 70%, preferably 5% to 40%, and a particularly preferred mass ratio of 5% to 15%, wherein the inorganic flame retardant may be specifically sodium chloride, potassium chloride, potassium bromide, antimony oxide etc. The phosphorus-based flame retardant may be ammonium polyphosphate, ammonium dihydrogen phosphate, diammonium hydrogen phosphate, red phosphorus etc. The nitrogen-based flame retardant may be selected from melamine, dicyandiamide, urea, or biuret etc., depending on specific propotions and applications.

The fire extinguishing composition above is loaded in a K type hot aerosol fire extinguishing apparatus, and a commercially available S type aerosol fire extinguisher or K type-aerosol fire extinguisher is loaded in the same fire extinguishing apparatus at the same time, specifically as follows:

Embodiment 1

50 g of a prepared composition sample of basic copper carbonate, ammonium dihydrogen phosphate and potassium chloride is added to a fire extinguishing apparatus loaded with 50 g of a K type aerosol generating agent to carry out a 93# gasoline fire extinguishing test of an oil disc having an area of 0.25 $cm^2$, the test result is shown in Test Record Table 1.

Embodiment 2

50 g of a prepared composition sample of copper oxalate, melamine and potassium chloride is added to a fire extinguishing apparatus loaded with 50 g of a K type aerosol generating agent to carry out a 93# gasoline fire extinguishing test of an oil disc having an area of 0.25 $cm^2$, the test result is shown in Test Record Table 1.

Embodiment 3

50 g of a prepared composition sample of copper acetate, ammonium dihydrogen phosphate and potassium chloride is added to a fire extinguishing apparatus loaded with 50 g of a K type aerosol generating agent to carry out a 93# gasoline fire extinguishing test of an oil disc having an area of 0.25 $cm^2$, the test result is shown in Test Record Table 1.

Embodiment 4

50 g of a prepared composition sample of copper carbonate, melamine and potassium chloride is added to a fire extinguishing apparatus loaded with 50 g of a K type aerosol generating agent to carry out a 93# gasoline fire extinguishing test of an oil disc having an area of 0.25 $cm^2$, the test result is shown in Test Record Table 1.

Embodiment 5

50 g of a prepared composition sample of copper oleate, ammonium dihydrogen phosphate and potassium chloride is added to a fire extinguishing apparatus loaded with 50 g of a K type aerosol generating agent to carry out a 93# gasoline fire extinguishing test of an oil disc having an area of 0.25 $cm^2$, the test result is shown in Test Record Table 1.

COMPARISON EXAMPLE 1

Carry out a 93# gasoline fire extinguishing test of an oil disc having an area of 0.25 $cm^2$ for a fire extinguishing apparatus sample only loaded with 100 g of a K type hot aerosol fire extinguisher, and the test result is shown in Test Record Table 1.

COMPARISON EXAMPLE 2

Carry out a 93# gasoline fire extinguishing test of an oil disc having an area of 0.25 $cm^2$ for a fire extinguishing apparatus sample only loaded with 100 g of an S type hot aerosol fire extinguisher, and the test result is shown in Test Record Table 1.

COMPARISON EXAMPLE 3 add 50 g of a composition sample of ammonium dihydrogen phosphate and potassium chloride to a fire extinguishing apparatus of a K type aerosol generating agent, carry out a 93# gasoline fire extinguishing test of an oil disc having an area of 0.25 $cm^2$, the test result is shown in Test Record Table 1.

50 g of the fire extinguishing composition of copper salts of the present disclosure was prepared and shaped according to a conventional preparation process, and added in fire extinguishing apparatuses loaded with 50 g of a K type aerosol generating agent respectively to carry out 8B fire extinguishing tests. The fire extinguishing tests were carried out with specific test models as specified in 6.3.2.1 in GA86-2009. Three shots were launched in each group and the tests were performed in a crossed manner. Samples of fire extinguishing apparatuses loaded with 100 g of a common S type aerosol fire extinguisher, a K type aerosol fire extinguisher and a coolant respectively were also provided in the comparison examples and fire extinguishing tests were performed in the same conditions. Specific results are shown in Table 1.

TABLE 1

Comparison of various composition components and comparison of test results

| | Composition content of embodiment (mass percent) | | | | | Comparison example | | |
|---|---|---|---|---|---|---|---|---|
| Components | 1 | 2 | 3 | 4 | 5 | 1 | 2 | 3 |
| K type agent | | | | | | • | | |
| S type agent | | | | | | | • | |
| basic copper carbonate | 36 | | | | | | | |
| copper acetate | | | 88 | | | | | |
| copper oxalate | | 60 | | | | | | |
| copper carbonate | | | | 70 | | | | |
| copper oleate | | | | | 37 | | | |
| ammonium dihydrogen phosphate | 37 | | | | 28 | | | 56 |
| malamine | | 15 | | 10 | | | | |
| potassium chloride | 20 | 20 | 6 | 13 | 29 | | | 38 |
| hydroxypropyl methylcellulose | 4.5 | 3 | 3.5 | 4.5 | 3 | | | 3.5 |
| magnesium stearate | 2.5 | | | 2.5 | 3 | | | 2.5 |
| talc | | 2 | 2.5 | | | | | |
| Test result | | | | | | | | |
| Fire extinguishing result | Completely extinguished | Completely extinguished | Completely extinguished | Completely extinguished | Completely extinguished | Not extinguished | Not extinguished | Not extinguished |

The S and K type fire extinguishers used in the first to the third comparison examples in the table above are commercially available fire extinguishers. It can be concluded through Table 1 that fire extinguishing compositions of copper salts of the first to the fifth embodiments of the present disclosure are capable of extinguish the fires in the oil disc experiments, and it can be seen that the fire extinguishing efficiency of the fire extinguishing compositions is higher than that in the first to the third comparison examples, and there is no naked fire on nozzles.

What is claimed is:

1. A fire extinguishing composition of copper salts, wherein the fire extinguishing composition contains a compound of copper salts and a fire retardant component, respectively in the following mass ratios:

30% to 95% of the compound of copper salts;

5% to 70% of the fire retardant component;

the fire extinguishing composition further comprises a pyrotechnic agent;

the pyrotechnic agent is adopted as a heat source and a power source of the fire extinguishing composition;

and the purpose of fire extinguishing is achieved by:

igniting the pyrotechnic agent, and the fire extinguishing composition performing decomposition reaction and generating a large quantity of fire extinguishing substance under high temperature produced by burning of the pyrotechnic agent, and the fire extinguishing substance being sprayed out together with the pyrotechnic agent;

wherein the fire extinguishing composition further comprises an additive and the mass percent thereof is more than 0 and less than or equal to 10%, and the additive is hydroxypropyl methylcellulose, an acetal adhesive, magnesium stearate or talcum powder or a combination thereof.

2. The fire extinguishing composition of copper salts according to claim 1, wherein the fire extinguishing composition comprises an organic copper compound or an inorganic copper compound or a combination thereof, and the mass percent thereof is within 60% to 90%.

3. The fire extinguishing composition of copper salts according to claim 2, wherein the melting point of the organic copper compound or the inorganic copper compound is above 100° C., and the decomposition temperature of which is above 200° C.

4. The fire extinguishing composition of copper salts according to claim 3, wherein the organic copper compound is copper acetate, copper oxalate, copper oleate, copper linoleate, copper stearate, copper citrate, copper tartrate, 2-hydroxybutanedioic copper, copper benzoate, or copper salicylate or a mixture thereof.

5. The fire extinguishing composition of copper salts according to claim 4, wherein the decomposition temperature of the fire retardant component in the fire extinguishing composition is above 100° C., and the fire retardant component releases compounds of gaseous, liquid or solid particles having a fire retardant effect during a decomposition process.

6. The fire extinguishing composition of copper salts according to claim 3, wherein the inorganic copper compound is copper carbonate, copper sulfate, copper nitrate, copper chloride, copper hydroxide, copper sulfite, basic copper carbonate or copper thiosulfate or a mixture thereof.

7. The fire extinguishing composition of copper salts according to claim 6, wherein the decomposition temperature of the fire retardant component in the fire extinguishing composition is above 100° C., and the fire retardant component releases compounds of gaseous, liquid or solid particles having a fire retardant effect during a decomposition process.

8. The fire extinguishing composition of copper salts according to claim 3, wherein the decomposition temperature of the fire retardant component in the fire extinguishing composition is above 100° C., and the fire retardant component releases compounds of gaseous, liquid or solid particles having a fire retardant effect during a decomposition process.

9. The fire extinguishing composition of copper salts according to claim 1, wherein the decomposition temperature of the fire retardant component in the fire extinguishing composition is above 100° C., and the fire retardant component releases compounds of gaseous, liquid or solid particles having a fire retardant effect during a decomposition process.

10. The fire extinguishing composition of copper salts according to claim 9, wherein the fire retardant component is an inorganic flame retardant, halogen-based flame retardant, a phosphorus-based flame retardant or a nitrogen-based flame retardant or a combination thereof, and the mass percent of the fire retardant component is within 5% to 15%.

11. The fire extinguishing composition of copper salts according to claim 10, wherein components and mass percent thereof in the fire extinguishing composition are as follows:

80% to 90% of a compound of copper salt;

5% to 15% of a fire retardant component;

1% to 5% of an additive.

* * * * *